US010743106B2

(12) United States Patent
Daley et al.

(10) Patent No.: US 10,743,106 B2
(45) Date of Patent: Aug. 11, 2020

(54) HEADPHONE EARCUP MOUNT IN CONTINUOUS HEADBAND-SPRING HEADPHONE SYSTEM

(71) Applicant: Bose Corporation, Framingham, MA (US)

(72) Inventors: Bennett P. Daley, Walham, MA (US); Eric Douglas Curtiss, East Boston, MA (US); Allen Timothy Graff, Sutton, MA (US); Richard Arthur Grebe, Stow, MA (US)

(73) Assignee: BOSE CORPORATION, Framingham, MA (US)

( * ) Notice: Subject to any disclaimer, the term of this patent is extended or adjusted under 35 U.S.C. 154(b) by 82 days.

(21) Appl. No.: 16/059,678

(22) Filed: Aug. 9, 2018

(65) Prior Publication Data

US 2020/0053463 A1 Feb. 13, 2020

(51) Int. Cl.
*H04R 5/033* (2006.01)
*H04R 1/10* (2006.01)

(52) U.S. Cl.
CPC ..... *H04R 5/0335* (2013.01); *H04R 1/105* (2013.01); *H04R 1/1066* (2013.01); *H04R 1/1075* (2013.01); *H04R 1/1008* (2013.01); *H04R 2201/02* (2013.01)

(58) Field of Classification Search
CPC .... H04R 5/0335; H04R 1/105; H04R 1/1066; H04R 1/1075; H04R 1/1008; H04R 2201/02
USPC ..... 381/370
See application file for complete search history.

(56) References Cited

U.S. PATENT DOCUMENTS

2007/0183616 A1* 8/2007 Wahl ..... H04M 1/05 381/370
2008/0175406 A1* 7/2008 Smith ..... H04R 1/1066 381/87
2013/0202126 A1* 8/2013 Chen ..... H04R 1/1041 381/74

(Continued)

FOREIGN PATENT DOCUMENTS

WO 2010008829 A1 1/2010
WO 2018057907 A1 3/2018

OTHER PUBLICATIONS

PCT International Search Report and Written Opinion for International Application No. PCT/US2019/044824, dated Oct. 4, 2019, 12 pages.

(Continued)

*Primary Examiner* — Sean H Nguyen
(74) *Attorney, Agent, or Firm* — Hoffman Warnick LLC

(57) ABSTRACT

Various implementations include headphone systems. In one implementation a headband for a headphone system includes: a continuous spring section sized to extend over a head of a user; an earcup mount coupled with an end of the continuous spring section, where the continuous spring section and the earcup mount form an arcuate joint, and where the earcup mount is configured to rotate relative to the continuous spring section at the arcuate joint; and a friction assembly spanning between the continuous spring section and the earcup mount, the friction assembly linearly arranged across the arcuate joint and configured to provide a substantially constant resistance to the rotation of the earcup mount relative to the continuous spring section.

20 Claims, 6 Drawing Sheets

(56) References Cited

U.S. PATENT DOCUMENTS

2014/0270228 A1* 9/2014 Oishi ..... H04R 1/10
381/74
2015/0222980 A1* 8/2015 Pizzaro ..... H04R 1/1058
381/371

OTHER PUBLICATIONS

Beoplay h9i headphone, available at: https://www.beoplay.com/en/products/beoplayh9i, downloaded on Nov. 21, 2018.
Parrot Zik 3 headphone, available at: https://www.parrot.com/us/audio/parrot-zik-3, downloaded on Nov. 21, 2018.
Shinola Canfield over-hear headphone, available at: https://www.shinola.com/audio/all/headphones/headphone-type/over-ear.html#/mode=gallery , downloaded on Nov. 21, 2018.
Libratone Q-Adapt on-hear headphone, available at: https://www.libratone.com/us/products/q-adapt-on-ear/q-adapt-on-ear-headphones , downloaded on Nov. 21, 2018.

* cited by examiner

HEADPHONE EARCUP MOUNT IN CONTINUOUS HEADBAND-SPRING HEADPHONE SYSTEM

TECHNICAL FIELD

This disclosure generally relates to headphones. More particularly, the disclosure relates to a headphone headband, and related headphone system having an adjustable earcup.

BACKGROUND

Conventional headphones include a set of earcups joined by a headband. In some of those conventional configurations, the headband is segmented and affixed to the earcups. The segmented headband can allow for adjustment of the earcup position by moving one or more segments of the headband relative to the other segments. In other conventional configurations, the earcup is attached to a headband via an actuator such as a knob/screw or pin mechanism. In these configurations, the position of the earcup can be adjusted via the actuator (e.g., by twisting the knob/screw to loosen and then tightening after adjustment). These conventional configurations can be unwieldy. Additionally, these conventional configurations can be difficult to accurately adjust in order to provide a desirable fit for the user. While advanced designs may enable smoother earcup adjustment, these designs may not adequately control multi-dimensional adjustment of those earcups.

SUMMARY

All examples and features mentioned below can be combined in any technically possible way.

Various implementations include headphone systems with a rotatable earcup mount. In some implementations, these headphone systems have a continuous headband spring with a rotatable earcup mount.

In some particular aspects, a headband for a headphone system includes: a continuous spring section sized to extend over a head of a user; an earcup mount coupled with an end of the continuous spring section, where the continuous spring section and the earcup mount form an arcuate joint, and where the earcup mount is configured to rotate relative to the continuous spring section at the arcuate joint; and a friction assembly spanning between the continuous spring section and the earcup mount, the friction assembly linearly arranged across the arcuate joint and configured to provide a substantially constant resistance to the rotation of the earcup mount relative to the continuous spring section.

In other particular aspects, a headphone system includes: a pair of earcups; and a headband coupled with the pair of earcups, the headband having: a continuous spring section sized to extend over a head of a user; an earcup mount coupled with one of the pair of earcups and an end of the continuous spring section, where the continuous spring section and the earcup mount form an arcuate joint, and where the earcup mount is configured to rotate relative to the continuous spring section at the arcuate joint; and a friction assembly spanning between the continuous spring section and the earcup mount, where the friction assembly is linearly arranged across the arcuate joint and configured to provide a substantially constant resistance to the rotation of the earcup mount relative to the continuous spring section.

Implementations may include one of the following features, or any combination thereof.

In certain cases, the friction assembly is located internal to an outer surface of each of the continuous spring section and the earcup mount and is positioned across the arcuate joint to contact an inner surface of the continuous spring section while the earcup mount rotates relative to the continuous spring section.

In some implementations, the friction assembly includes a coupler having: a first mating feature connected with a first complementary mating feature in the continuous spring section; and a second mating feature connected with a second complementary mating feature in the earcup mount. In particular aspects, the coupler has a primary axis extending across the arcuate joint, and the earcup mount rotates off-axis relative to the primary axis of the coupler. In certain cases, the coupler includes an aperture extending therethrough for housing a cable. In particular aspects, the coupler includes a shaft (e.g., a screw or a pin). In certain implementations, the first mating feature includes a thread and the first complementary mating feature includes a complementary thread, and the second mating feature has a lip and the second complementary mating feature has a shelf contacting the lip.

In some aspects, the headband further includes a circumferentially extending slot within an outer surface of the coupler. In particular implementations, the headband further includes: an upper collar in the continuous spring section at least partially surrounding the coupler, the upper collar defining the first complementary mating feature; a lower collar in the earcup mount at least partially surrounding the coupler, the lower collar defining the second complementary mating feature; and an O-ring between the coupler and one of the upper collar or the lower collar, where the O-ring is located in the circumferentially extending slot in the coupler. In certain cases, the headband further includes: a bushing surrounding the coupler and contacting each of the upper collar and the lower collar; and a washer between the second mating feature and the second complementary mating feature, where the second complementary mating feature is defined by the upper collar or the lower collar. In particular aspects, the bushing has a non-uniform radial thickness around the coupler for maintaining alignment of the coupler during rotation of the earcup mount relative to the continuous spring section.

In certain cases, the headphone system further includes: an upper collar in the continuous spring section at least partially surrounding the coupler, the upper collar defining the first complementary mating feature; a lower collar in the earcup mount at least partially surrounding the coupler, the lower collar defining the second complementary mating feature; an O-ring between the coupler and one of the upper collar or the lower collar, where the O-ring is located in the circumferentially extending slot in the coupler; a bushing surrounding the coupler and contacting each of the upper collar and the lower collar; a washer between the second mating feature and the second complementary mating feature, where the second complementary mating feature is defined by the upper collar or the lower collar, where the bushing has a non-uniform radial thickness around the coupler for maintaining alignment of the coupler during rotation of the earcup mount relative to the continuous spring section, and where the earcup mount includes an internal slot with an opening along an inner surface thereof, where the one of the pair of earcups is coupled with the earcup mount in the opening, and is configured to move within the opening along a length of the earcup mount.

Two or more features described in this disclosure, including those described in this summary section, may be combined to form implementations not specifically described herein.

The details of one or more implementations are set forth in the accompanying drawings and the description below. Other features, objects and benefits will be apparent from the description and drawings, and from the claims.

Figure 1:
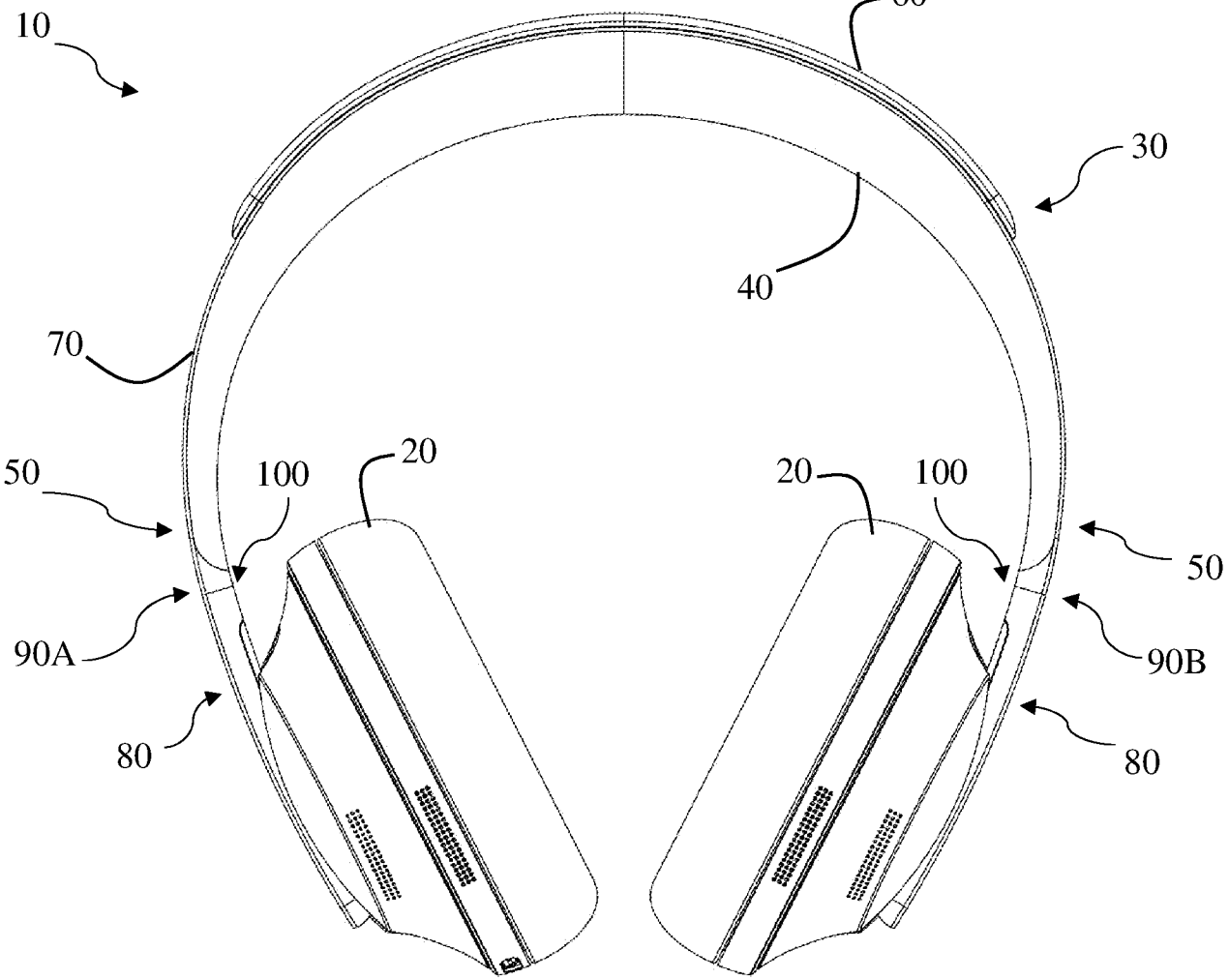
FIG. 1 shows a perspective view of a headphone system according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that an earcup mount and friction assembly can be beneficially incorporated into a continuous headband spring headphone system. For example, a headphone system can include a continuous headband spring with an earcup adjustment apparatus that provides an effective, consistent and smooth mode of adjustment for a set of earcups.

Commonly labeled components in the FIGURES are considered to be substantially equivalent components for the purposes of illustration, and redundant discussion of those components is omitted for clarity.

A headphone refers to a device that fits around, on, or in an ear and that radiates acoustic energy into the ear canal. Headphones are sometimes referred to as earphones, earpieces, headsets, earbuds or sport headphones, and can be wired or wireless. A headphone includes an acoustic driver to transduce audio signals to acoustic energy. The acoustic driver may be housed in an earcup. While some of the figures and descriptions following may show a single headphone, a headphone may be a single stand-alone unit or one of a pair of headphones (each including a respective acoustic driver and earcup), one for each ear. A headphone may be connected mechanically to another headphone, for example by a headband and/or by leads that conduct audio signals to an acoustic driver in the headphone. A headphone may include components for wirelessly receiving audio signals. A headphone may include components of an active noise reduction (ANR) system. Headphones may also include other functionality such as a microphone so that they can function as a headset.

In an around or on-the-ear headphone, the headphone may include a headband and at least one earcup that is arranged to sit on or over an ear of the user. In order to accommodate heads of different sizes and shapes, the earcups are configured to pivot about the vertical and/or horizontal axes, and to translate for some distance along the vertical axis.

Headphones according to various implementations herein can include a continuous headband spring coupled with one or more earcups. The headband spring can provide the desired clamping pressure in the headphones in order to maintain contact between the earcup(s) and the user's head. In the dual-earcup configuration, the headband spring can provide a significant portion (e.g., nearly all) of the clamping pressure between the earcups. This continuous headband spring can be formed of a single piece of material (e.g., a metal or composite material) or can be formed of a plurality of separate pieces coupled together. The continuous headband spring can be coupled with a head cushion for interfacing with a user's head. In particular cases, the continuous headband spring connects a pair of earcups. This continuous headband spring configuration can allow for adjustment of the position of the earcups without modifying a position of the headband spring or the cushion. That is, the continuous headband spring configuration allows the user to adjust the position of the earcups relative to the headband spring, without altering the length of the headband spring (or the cushion).

FIG. 1 shows a perspective view of a headphone system 10 according to various implementations. As shown, headphone system 10 can include a pair of earcups 20 configured to fit over the ear, or on the ear, of a user. A headband 30 spans between the pair of earcups 20 (individually labeled as earcups 20) and is configured to rest on the head of the user (e.g., spanning over the crown of the head or around the head). The headband 30 can include a head cushion 40, which is coupled with a continuous headband spring (also called a "continuous spring section") 50 (partially obstructed by head cushion 40 in this view). A headband cover 60 is also shown covering a portion of the outer surface 70 of the continuous spring section 50.

According to various implementations, the continuous spring section 50 connects the pair of earcups 20, and permits movement of the earcup(s) 20 without modifying a length of the continuous spring section 50. That is, according to various implementations, earcups 20 are configured to move independently of the outer surface 70 of the continuous spring section 50, such that earcups 20 appear to slide, rotate or otherwise translate relative to the continuous spring section 50.

FIG. 1 also illustrates an earcup mount 80 (two shown) coupled with an end 90A, 90B of the continuous spring section (or simply, spring section 50). As illustrated in FIG. 1, earcup mounts 80 can be coupled with opposite ends 90A, 90B of the spring section 50. In various implementations, the spring section 50 and each earcup mount 80 form an arcuate joint 100. The arcuate joint 100 is defined by the junction of the two arcuate segments: the spring section 50 and the earcup mount 80. In other terms, a line formed along adjoining surfaces of the spring section and the earcup mount 80 is non-linear, in that it forms at least a partial arc across these surfaces. As described further herein, the earcup mount 80 is configured to rotate relative to the spring section 50 at the arcuate joint 100.

Figure 2:
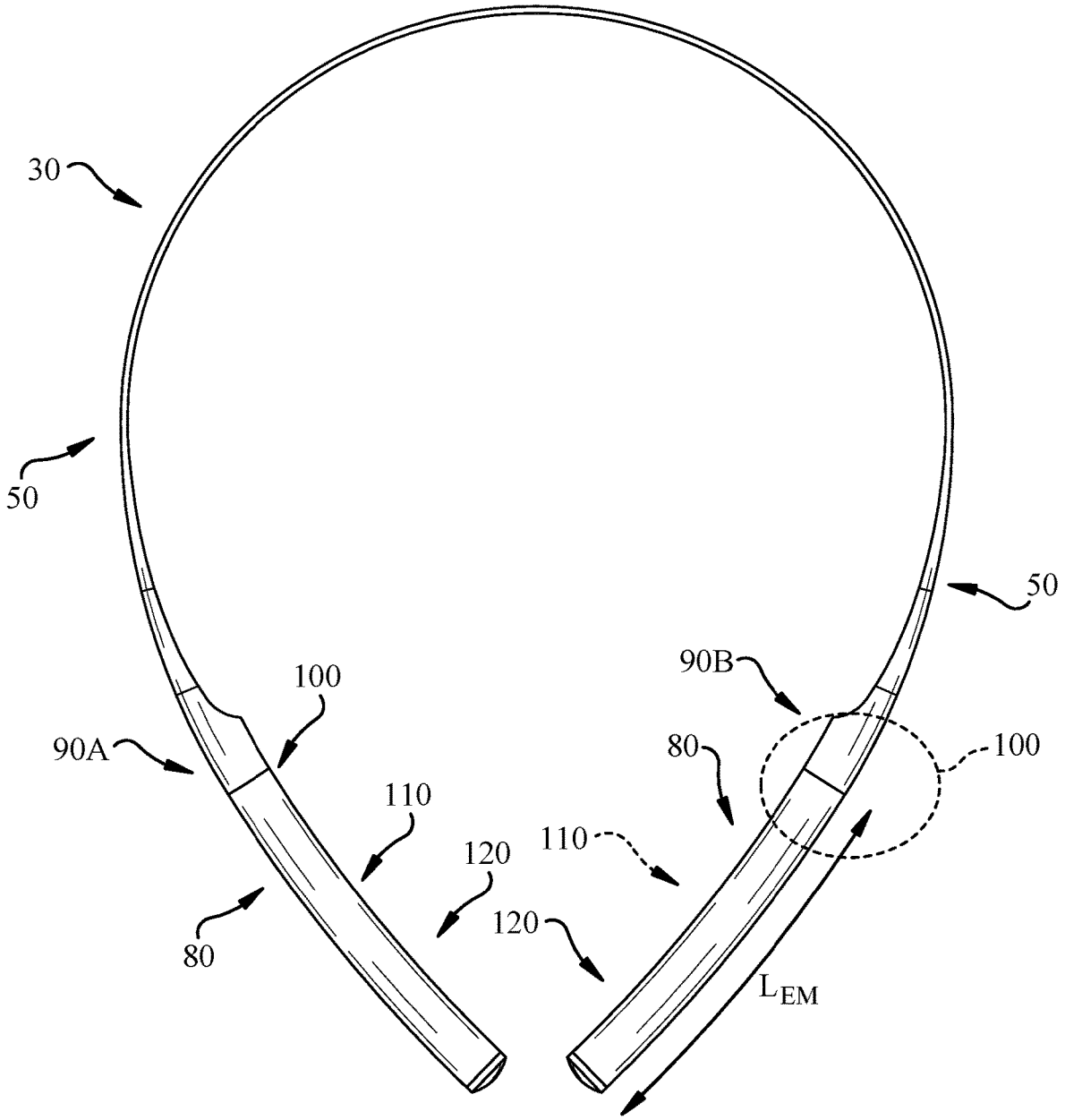
FIG. 2 shows a perspective view of a continuous headband spring section coupled with an earcup mount according to various implementations.

FIG. 2 shows a perspective view of the continuous spring section (or simply, spring section) 50 and the earcup mount 80 in isolation. As shown, in some implementations, the spring section 50 can have a varying thickness across its length, e.g., a thicker region proximate each of the ends 90A, 90B for coupling with a spring section 50. However, in other implementations, the spring section 50 can have a substantially uniform thickness across its length. In particular implementations, the thickness of the spring section 50 and the earcup mount 80 at the joint 100 can be substantially identical, such that the joint 100 has a smooth outer surface as the earcup mount 80 rotates about the spring section 50. As described herein, the earcup mount 80 can be configured to rotate relative to the spring section 50 to permit movement of the earcups 20 (FIG. 1). Additionally, as is partially shown in FIG. 2, the earcup mount 80 can include an internal slot 110 within an opening along an internally facing surface 120 for coupling one of the earcups 20 to the mount 80 (FIG. 1). In these cases, the earcup 20 (FIG. 1) is configured to move within the opening along a length (LEM) of the earcup mount 80. Additional features of the earcup 20, earcup mount 80, and adjustment mechanisms in a headphone system are described in U.S. patent application Ser. No. 15/726,760, which is hereby incorporated by reference in its entirety.

Figure 3:
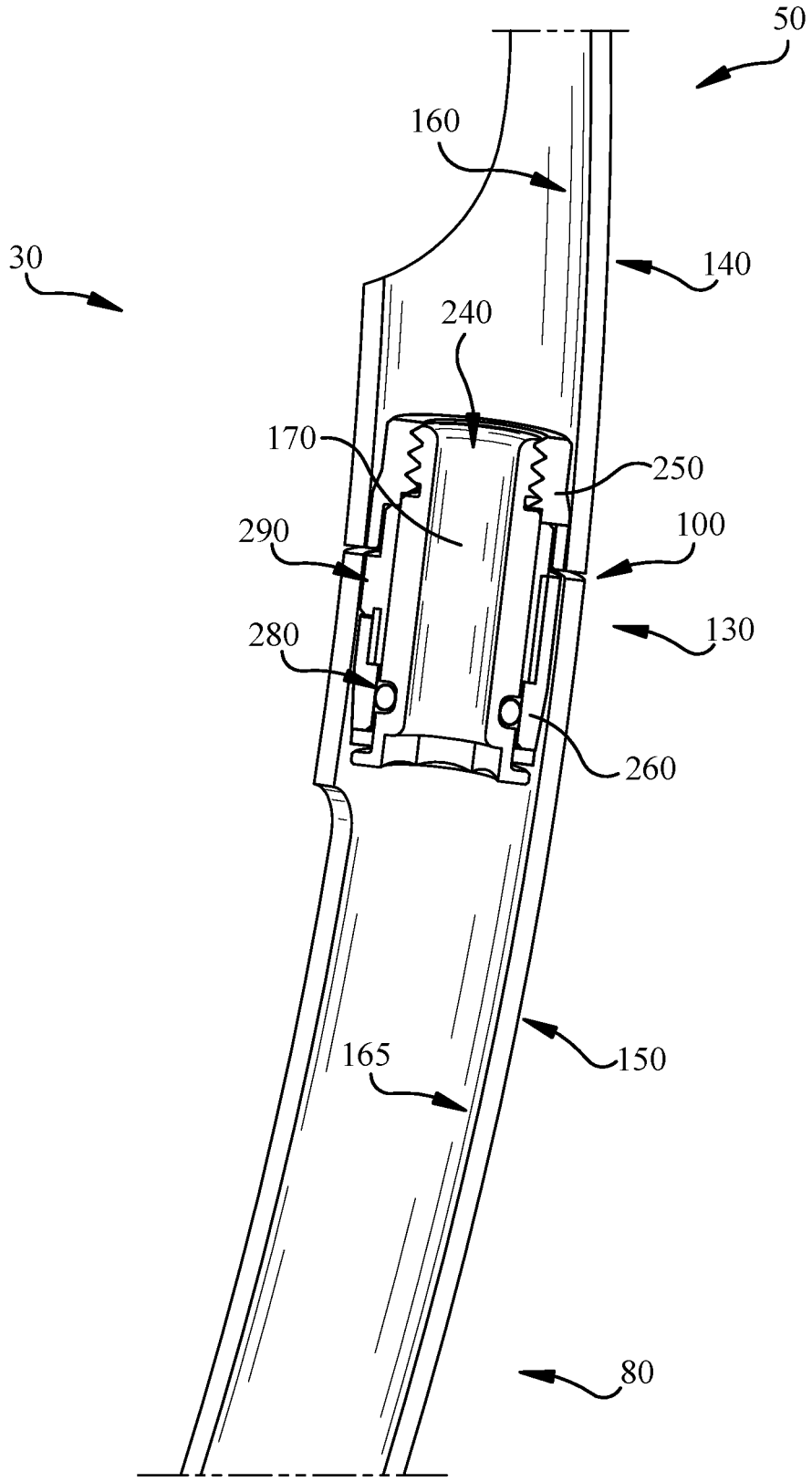
FIG. 3 shows a cross-sectional view of a joint between a continuous headband spring section and an earcup mount, according to various implementations.
Figure 4:
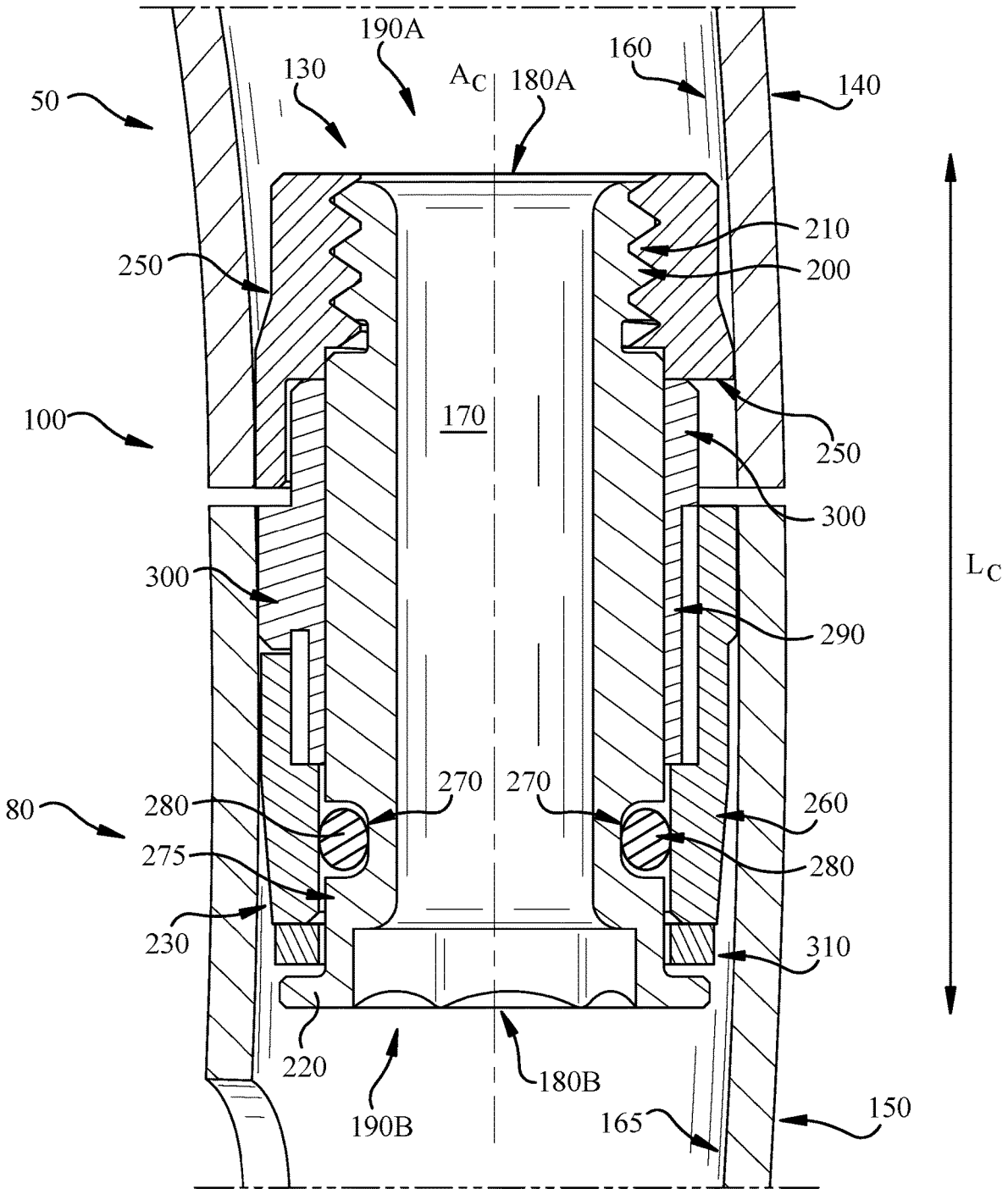
FIG. 4 shows a close-up cross-sectional view of the joint between the continuous headband spring section and the earcup mount of FIG. 3.

FIG. 3 shows a cross-sectional view of the spring section 50 and the earcup mount 80 at the joint 100. As shown in this view, the headband 30 can further include a friction assembly 130 spanning between the spring section 50 and the earcup mount 80. In particular implementations, the friction assembly 130 is linearly arranged across the arcuate joint 100, and is configured to provide a substantially constant resistance to the rotation of the earcup mount 80 relative to the spring section 50. FIG. 4 shows a close-up cross-sectional view of the friction assembly 130, illustrating additional features of that assembly 130. FIGS. 3 and 4 are referred to concurrently.

In particular, FIGS. 3 and 4 show the friction assembly 130 located internal to an outer surface 140 of the spring section 50 and an outer surface 150 of the earcup mount 80, such that the friction assembly 130 is not visible when the headband 30 is assembled. As described herein, the friction assembly 130 is positioned across the arcuate joint 100 to contact an inner surface 160 of the spring section 50 and an inner surface 165 of the earcup mount 80, while the earcup mount 80 rotates relative to the spring section 50. That is, the linear arrangement of the friction assembly 130 can cause interference with the inner surface 160 of the spring section 50 and the inner surface 165 of the earcup mount 80 during rotation of the earcup mount 80 to provide constant resistance to that rotation.

FIG. 4 shows a close-up view of the friction assembly 130, which includes a coupler 170 extending across the arcuate joint 100 between the earcup mount 80 and the spring section 50. The linear arrangement of the friction assembly 130 is particularly evident in FIG. 4, which shows a primary axis ($A_C$) of the coupler 170 as following a linear, or straight, path. This primary axis ($A_C$) can be defined as a line extending the length ($L_c$) of the coupler 170 that intersects the central points 180A, 180B of the coupler 170 at opposite ends 190A, 190B. As will be described herein, the earcup mount 80 is configured to rotate off-axis relative to the primary axis ($A_C$) of the coupler 170, helping to maintain constant contact between the earcup mount 80 and the friction assembly 130.

As shown in FIG. 4, the coupler 170 can include a first mating feature 200 connected with a complementary mating feature 210 in the spring section 50, as well as a second mating feature 220 connected with a second complementary mating feature 230 in the earcup mount 80. In particular implementations, the coupler 170 can include a shaft, such as a screw or a pin. The coupler 170 can be formed of a metal, plastic or a composite material, and is capable of withstanding wear associated with rotation of the earcup mount 80 relative to the spring section 50. In some implementations, the coupler 170 can include an aperture 240 extending therethrough for housing a cable, such as a wire or other electrical connection between components in the headphone system 10. The mating features 200, 220 on the coupler 170 can be integral to the body of the coupler 170, or in some cases, can be separate components joined (e.g., adhered, welded, press-fit, matingly fit) to the body of the coupler 170.

In particular implementations, the first mating feature 200 of the coupler 170 can include a thread, and the first complementary mating feature 210 in the spring section 50 can include a complementary thread. In some cases, the second mating feature 220 of the coupler 170 can include a lip, and the second complementary mating feature 230 in the earcup mount 80 can include a shelf contacting the lip. However, it is understood that these are only some examples of mating features which can be used to join the coupler 170 with each of the spring section 50 and the earcup mount 80. Additional example mating features can include pin/slot configurations, tongue/groove configurations, rivet configurations, adhesive couplings, press-fit couplings, snap-fit couplings, welded couplings and/or other known mating couplings. Certain coupling configurations can be combined, e.g., using a threaded coupling with an adhesive such as a glue. Additionally, intervening materials or components such as washers, lubricants, or sleeves can be located between mating features in some implementations.

In some example implementations, the friction assembly 130 further includes an upper collar 250 in the spring section 50 that at least partially surrounds the coupler 170. This upper collar 250 can define the first complementary mating feature 210, e.g., a thread, slot, lip or protrusion. The friction assembly 130 can further include a lower collar 260 in the earcup mount 80 that at least partially surrounds the coupler 170. This lower collar 260 can define the second complementary mating feature 230, e.g., a thread, slot, lip or protrusion. The upper collar 250 and lower collar 260 are referred to as at least partially surrounding the coupler 170, in that one or both collars 250 may extend only partially circumferentially about the corresponding portion of the coupler 170. However, in other cases, the upper collar 250 and/or lower collar 260 extend entirely circumferentially around the coupler 170 proximate the respective mating features 200, 220 of the coupler 170. The upper collar 250 and lower collar 260 can be integrally formed with the spring section 50 and earcup mount 80, respectively (e.g., via molding or additive manufacturing), or can be separately formed and joined (e.g., via fastening, adhesion or other fitting described herein). In any case, the upper collar 250 is a fixture in the spring section 50 and the lower collar 260 is a fixture in the earcup mount 80.

In certain implementations, the coupler 170 has a circumferentially extending slot 270 within its outer surface 275. In certain cases, the circumferentially extending slot 270 extends entirely around the body of the coupler 170 in the circumferential dimension. It is understood that the circumferentially extending slot 270 can be located proximate the upper collar 250 or the lower collar 260 (or two slots could be present, one proximate each of the collars 250, 260). While the circumferentially extending slot 270 is shown proximate the lower collar 260 in the example in FIG. 4, this scenario could be inverted. In certain cases, the friction assembly 130 can further include an O-ring 280 between the coupler 170 and the upper collar 250 or lower collar 260 (lower collar example shown). In these cases, the O-ring 280 can be located in the circumferentially extending slot 270 in the coupler 170. As with the circumferentially extending slot 270 in the collar 170, the O-ring 280 can be located proximate the upper collar 250 or the lower collar 260, and additional O-rings may be used to provide friction between the friction assembly 130 and the earcup mount 80 and/or spring section 50.

In particular cases, the O-ring 280 is compressed to fit in the slot 270, such that the O-ring 280 provides a radially outward force against the lower collar 260 at all times. This constant outward force generates friction between the coupler 170/O-ring 280 and the lower collar 260 while the earcup mount 80 is rotated relative to the spring section 50.

In some implementations, the friction assembly 130 further includes a bushing 290 surrounding the coupler 170 and contacting each of the upper collar 250 and the lower collar 260. That is, the bushing 290 can span across the arcuate joint 100, and be located radially inward of portions of each collar 250, 260. The bushing 290 can be a floating piece that is fitted between the coupler 170 and the collars 250, 260, or can be affixed to one or more of the collars 250, 260, the spring section 50 or the earcup mount 80. In various example implementations, the bushing 290 has a non-uniform radial thickness around the coupler 170, which can help to maintain alignment of the coupler 170 during rotation of the earcup mount 80 relative to the continuous spring section 50. That is, the bushing 290 can include one or more radial protrusions 300, which each extend radially beyond the radial inner surfaces of the collars 250, 260. In some cases, the radial protrusion(s) 300 help align and/or retain the coupler 170 between the spring section 50 and the earcup mount 80, e.g., where a lower protrusion 300 on the bushing 290 acts as a keying or locking feature with the lower collar 260, and an upper protrusion 300 on the bushing 290 acts as a rotation stop. However, in other implementations, the bushing 290 or other bushing can have a substantially uniform wall thickness.

Figure 5:
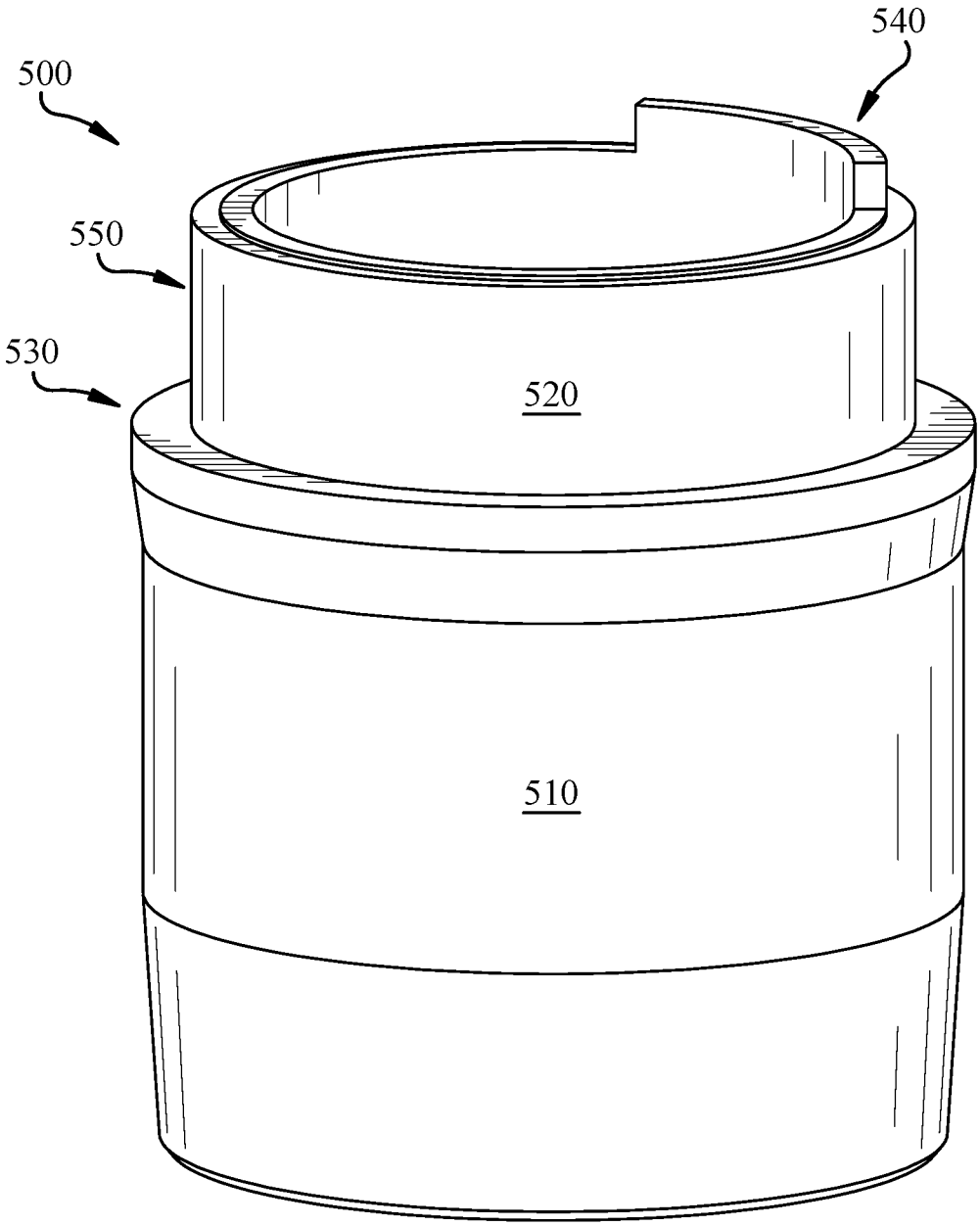
FIG. 5 shows a perspective view of a collar according to various additional implementations.
Figure 6:
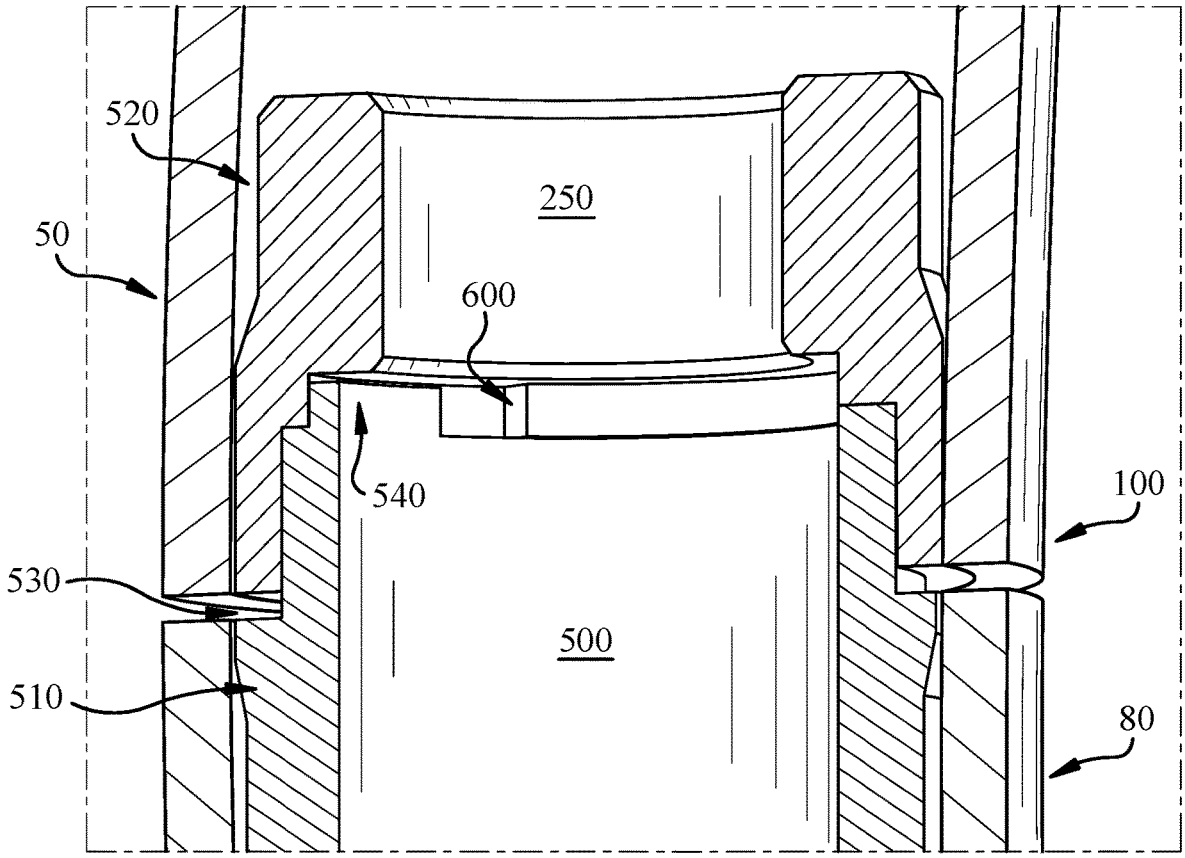
FIG. 6 shows a perspective view of the collar of FIG. 5 in a joint between a continuous headband spring section and an earcup mount, according to various implementations.

In additional implementations, as illustrated in the perspective view of FIG. 5, a combined collar/bushing component can be used to perform functions associated with the separate lower collar 260 and bushing 290 illustrated in FIG. 4. This component is labeled bushing 500. It is further understood that bushing 500 could be inverted to serve combined functions of the upper collar 250 and bushing 290. FIG. 6 shows a cross-sectional depiction of a portion the joint 100 including the collar 500 interacting with an upper collar, e.g., upper collar 250 (FIG. 4). Referring to FIGS. 5 and 6, the collar 500 can include two distinct sections, e.g., a lower section 510 and an upper section 520. The lower section 510 and upper section 520 can have distinct outer dimensions, such that these two sections 510, 520 define a lip (or shelf) 530. In some cases, the upper section 520 (having the smaller outer dimension) includes a rotation stop 540, which can include a protrusion spanning only partially circumferentially relative to the upper section 520. The rotation stop 540 can extend lengthwise relative to the upper section 520, i.e., where the rotation stop 540 extends from the body 550 of the upper section 520 along the lengthwise direction (Lc) of the coupler 170 (FIG. 4). The rotation stop 540 can limit rotation of the collar 500 relative to an upper collar (e.g., upper collar 250). FIG. 6 shows the collar 500 in the joint 100, including the rotation stop 540 interacting with a radial protrusion 600 in an upper collar (e.g., upper collar 250).

Returning to FIG. 4, in some implementations, a washer 310 can be located between the second mating feature 220 and the second complementary mating feature 230. The washer 310 can help to mitigate localized stress on the coupler 170 and the lower collar 260, for example, by absorbing a portion of the load applied across the arcuate joint 100 in the axial direction.

In any case, during operation, the first mating feature 200 and first complementary mating feature 210 keep the coupler 170 fixed to the spring section 50, while the earcup mount 80 is configured to rotate about the fixed coupler 170. The linear arrangement of the friction assembly 130 provides constant interference between the friction assembly 130 and the earcup mount 80, e.g., such that the O-ring 280 provides a substantially constant force against the lower collar 260 during rotation of the earcup mount 80. This force limits sticking, slip or other inconsistencies in movement of the earcup mount 80 relative to the spring section 50, such that the user feels a substantially smooth, consistent resistance to this rotating motion (accounting for a slightly higher resistance to movement from rest as compared with continuous motion).

One or more components described herein can be formed according to known manufacturing methods, e.g., molding, casting, forging or additive (e.g., three-dimensional) manufacturing, and can be formed from known materials, e.g., a metal such as aluminum or steel, a thermoplastic material (e.g., polycarbonate (PC) or acrylonitrile butadiene styrene (ABS)) or a composite material (e.g., PC/ABS). Certain components can include materials used for damping motion, such as silicone, a thermoplastic (e.g., POM) or a thermoplastic elastomer (TPE).

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other implementations are within the scope of the following claims.

We claim:

1. A headband for a headphone system, the headband comprising:

a continuous spring section sized to extend over a head of a user;

an earcup mount coupled with an end of the continuous spring section, wherein the continuous spring section and the earcup mount form an arcuate joint, and wherein the earcup mount is configured to rotate relative to the continuous spring section at the arcuate joint, wherein the rotation of the earcup mount includes a twisting rotation of the earcup mount relative to the continuous spring section; and a friction assembly spanning between the continuous spring section and the earcup mount, the friction assembly linearly arranged across the arcuate joint and configured to provide a substantially constant resistance to the rotation of the earcup mount relative to the continuous spring section.

2. The headband of claim 1, wherein the friction assembly is located internal to an outer surface of each of the continuous spring section and the earcup mount and is positioned across the arcuate joint to contact an inner surface of the continuous spring section while the earcup mount rotates relative to the continuous spring section, wherein the linear arrangement of the friction assembly causes interference with the inner surface of the continuous spring section during the twisting rotation to provide the substantially constant resistance to the twisting rotation.

3. The headband of claim 1, wherein the friction assembly comprises a coupler comprising:

a first mating feature connected with a first complementary mating feature in the continuous spring section; and a second mating feature connected with a second complementary mating feature in the earcup mount.

4. The headband of claim 3, wherein the coupler has a primary axis extending across the arcuate joint, and wherein the earcup mount rotates off-axis relative to the primary axis of the coupler, causing interference between the continuous spring section and the earcup mount to provide the substantially constant resistance to the twisting rotation.

5. The headband of claim 3, wherein the coupler comprises an aperture extending therethrough for housing a cable, and wherein the coupler comprises a shaft.

6. The headband of claim 3, wherein the first mating feature comprises a thread and the first complementary mating feature comprises a complementary thread, and wherein the second mating feature comprises a lip and the second complementary mating feature comprises a shelf contacting the lip.

7. The headband of claim 3, further comprising a circumferentially extending slot within an outer surface of the coupler.

8. The headband of claim 7, further comprising:

an upper collar in the continuous spring section at least partially surrounding the coupler, the upper collar defining the first complementary mating feature;

a lower collar in the earcup mount at least partially surrounding the coupler, the lower collar defining the second complementary mating feature; and an O-ring between the coupler and one of the upper collar or the lower collar, wherein the O-ring is located in the circumferentially extending slot in the coupler.

9. The headband of claim 8, further comprising:

a bushing surrounding the coupler and contacting each of the upper collar and the lower collar; and a washer between the second mating feature and the second complementary mating feature, wherein the second complementary mating feature is defined by the upper collar or the lower collar.

10. The headband of claim 9, wherein the bushing has a non-uniform radial thickness around the coupler for maintaining alignment of the coupler during rotation of the earcup mount relative to the continuous spring section.

11. A headphone system comprising:

a pair of earcups; and a headband coupled with the pair of earcups, the headband comprising:

a continuous spring section sized to extend over a head of a user;

an earcup mount coupled with one of the pair of earcups and an end of the continuous spring section, wherein the continuous spring section and the earcup mount form an arcuate joint, and wherein the earcup mount is configured to rotate relative to the continuous spring section at the arcuate joint; and a friction assembly spanning between the continuous spring section and the earcup mount, wherein the friction assembly is linearly arranged across the arcuate joint and configured to provide a substantially constant resistance to the rotation of the earcup mount relative to the continuous spring section, wherein the continuous spring section provides nearly all of the clamping pressure between the earcups when worn over the head of the user.

12. The headphone system of claim 11, wherein the friction assembly is positioned across the arcuate joint to contact an inner surface of the continuous spring section while the earcup mount rotates relative to the continuous spring section, wherein the arcuate joint is defined by a junction of two arcuate segments comprising a first arcuate segment in the continuous spring section and a second arcuate segment in the earcup mount, wherein the linear arrangement of the friction assembly causes interference with the inner surface of the continuous spring section during the rotation to provide the substantially constant resistance to the rotation.

13. The headphone system of claim 11, wherein the friction assembly comprises a coupler comprising:

a first mating feature connected with a first complementary mating feature in the continuous spring section; and a second mating feature connected with a second complementary mating feature in the earcup mount.

14. The headphone system of claim 13, wherein the coupler has a primary axis extending across the arcuate joint, and wherein the earcup mount rotates off-axis relative to the primary axis of the coupler.

15. The headphone system of claim 13, wherein the coupler comprises an aperture extending therethrough for housing a cable, and wherein the coupler comprises a shaft.

16. The headphone system of claim 13, wherein the first mating feature comprises a thread and wherein the first complementary mating feature comprises a complementary thread, and wherein the second mating feature comprises a lip, and wherein the second complementary mating feature comprises a shelf contacting the lip.

17. The headphone system of claim 13, further comprising a circumferentially extending slot within an outer surface of the coupler.

18. The headphone system of claim 17, further comprising:

an upper collar in the continuous spring section at least partially surrounding the coupler, the upper collar defining the first complementary mating feature;

a lower collar in the earcup mount at least partially surrounding the coupler, the lower collar defining the second complementary mating feature;

an O-ring between the coupler and one of the upper collar or the lower collar, wherein the O-ring is located in the circumferentially extending slot in the coupler;

a bushing surrounding the coupler and contacting each of the upper collar and the lower collar;

a washer between the second mating feature and the second complementary mating feature, wherein the second complementary mating feature is defined by the upper collar or the lower collar, wherein the bushing has a non-uniform radial thickness around the coupler for maintaining alignment of the coupler during rotation of the earcup mount relative to the continuous spring section, and wherein the earcup mount comprises an internal slot with an opening along an inner surface thereof, wherein the one of the pair of earcups is coupled with the earcup mount in the opening, and is configured to move within the opening along a length of the earcup mount.

19. A headphone system comprising:

a pair of earcups; and a headband coupled with the pair of earcups, the headband comprising:

a continuous spring section sized to extend over a head of a user;

an earcup mount coupled with one of the pair of earcups and an end of the continuous spring section, wherein the continuous spring section and the earcup mount form an arcuate joint, and wherein the earcup mount is configured to rotate relative to the continuous spring section at the arcuate joint; and a friction assembly spanning between the continuous spring section and the earcup mount, wherein the friction assembly is linearly arranged across the arcuate joint and configured to provide a substantially constant resistance to the rotation of the earcup mount relative to the continuous spring section, wherein the earcup mount allows for both translation and rotation of the earcups relative to the continuous spring section without altering a length of the continuous spring section.

20. The headphone system of claim 19, wherein the friction assembly is positioned across the arcuate joint to contact an inner surface of the continuous spring section while the earcup mount rotates relative to the continuous spring section, wherein the arcuate joint is defined by a junction of two arcuate segments comprising a first arcuate segment in the continuous spring section and a second arcuate segment in the earcup mount, wherein the linear arrangement of the friction assembly causes interference with the inner surface of the continuous spring section during the rotation to provide the substantially constant resistance to the rotation.

* * * * *